US007572665B2

(12) United States Patent
Datta et al.

(10) Patent No.: US 7,572,665 B2
(45) Date of Patent: Aug. 11, 2009

(54) MICROELECTRONICS GRADE METAL SUBSTRATE, RELATED METAL-EMBEDDED DEVICES AND METHODS FOR FABRICATING SAME

(75) Inventors: Arindom Datta, Madison, WI (US); Xiaochun Li, Madison, WI (US); Hongseok Choi, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 375 days.

(21) Appl. No.: 11/255,892

(22) Filed: Oct. 21, 2005

(65) Prior Publication Data

US 2007/0092995 A1 Apr. 26, 2007

(51) Int. Cl.
*H01L 21/00* (2006.01)

(52) U.S. Cl. ..... 438/64; 438/57; 438/106; 438/125; 257/433; 257/E21.502; 257/E21.511

(58) Field of Classification Search ..... 438/106, 438/108, 125, 57, 64; 257/433, E21.499, 257/E21.502, E21.505, E21.511
See application file for complete search history.

(56) References Cited

U.S. PATENT DOCUMENTS 5,825,049 A * 10/1998 Simmons et al. ..... 257/25
6,379,929 B1 * 4/2002 Burns et al. ..... 435/91.2
6,944,360 B2 9/2005 Li et al.
7,038,277 B2 * 5/2006 Chu et al. ..... 257/347
7,067,360 B2 * 6/2006 Lee ..... 438/151
7,259,449 B2 * 8/2007 Floyd ..... 257/678
2001/0010360 A1 * 8/2001 Oda ..... 250/338.1
2006/0208765 A1 * 9/2006 Juhola ..... 327/1

* cited by examiner

*Primary Examiner*—Alexander G Ghyka
*Assistant Examiner*—Seahvosh J Nikmanesh
(74) *Attorney, Agent, or Firm*—Lathrop & Clark LLP

(57) ABSTRACT

Fabricating a microelectronics grade metal substrate comprises forming the metal substrate on a sacrificial substrate. An adhesion layer can be deposited on or over the surface of the sacrificial substrate. A seed layer of the metal can be deposited on or over the adhesion layer. The metal material can be deposited on the seed layer by electroplating or other low-temperature, low-stress process to form a microelectronics-grade metal substrate. Thin film sensors and/or other microelectronic devices, followed by appropriate insulating layer(s), may be fabricated on or over the sacrificial substrate before forming the metal substrate. The sacrificial silicon substrate can then be etched away, leaving the microelectronics-grade metal substrate, and possibly the microelectronics device. Another insulating layer(s), followed by another adhesion layer, another seed layer and additional amounts of the material forming the metal substrate can then be deposited over the now-exposed microelectronics device to encapsulate it within a metal shell.

17 Claims, 12 Drawing Sheets

MICROELECTRONICS GRADE METAL SUBSTRATE, RELATED METAL-EMBEDDED DEVICES AND METHODS FOR FABRICATING SAME

The subject matter of this application was made with U.S. Government support awarded by the following agencies: NSF 0330356. The United States has certain rights to this application.

BACKGROUND OF THE INVENTION

1. Field of the Invention

This invention is directed to microelectronic grade substrates and related metal-embedded devices and methods for making such substrates and related meal-embedded devices.

2. Related Art

Embedding sensors into a mass of material allows the sensors to sense the value of a parameter of the mass in a way that often is not possible with surface mounted sensors. Some material data, such as that relating to the internal thermal and mechanical properties of the material, can only be collected in situ by sensors. For example, internal temperature and strain data is obtained by embedding sensors into a component, with information from remote areas being extrapolated from an array of such sensors. Moreover, due to the shape, size and/or use of the sensor and/or the device being sensed, mounting the sensors to the outside of the mass of the material might not always be possible. Such material masses include tools, dies, and the like, such as molds, drill bits, and cutter bits, elements of machines, such as turbine blades of aero-engines, static components of machines and systems, such as pressure vessels and pipes, and the like.

Published Patent Application 2004/0184700 to Li et al. discloses a number of embedded sensor structures. In FIGS. 3-4B, the '700 published patent application discloses a number of embodiments of an embedded sensor. In FIGS. 4A and 4B, the '700 published patent application discloses a method for forming a thin film microelectronic sensor on a metal substrate, then putting an encapsulating metal layer over the thin film sensor.

The '700 published patent application discloses a method for embedding a thin-film sensor in a high temperature metal bulk material. This method calls for a thin-film sensor to be fabricated on the surface of a metal substrate. First, an insulating or dielectric layer is deposited on the surface of the metal substrate. Then, a thin film sensor is fabricated on this surface using standard photolithographic processes. The sensor is then coated with an insulating ceramic layer, coated with a thin seed layer of the metal matrix material, and electroplated with the same bulk metal matrix material to further encapsulate the sensor. The sensor can then be surrounded by the bulk material by casting or by using a similar process, placing the sensor at the appropriate location within the fabricated component. The '700 published patent application also describes a number of methods for embedding fiber optic sensors in a high melting temperature bulk material and for collecting data from an embedded sensor.

SUMMARY OF THE DISCLOSED EMBODIMENTS

Although the '700 published patent application discloses a method for embedding sensors into a high melting temperature metal matrix material, in practice it is technically difficult and commercially impractical to produce sensor devices using the methods disclosed in the '700 published patent application. In particular, attempts to fabricate a thin-film mechanical sensor on a metal substrate yielded few, if any, functional embedded sensors.

The process of forming a thin-film mechanical, thermomechanical or other type of sensor onto a metal substrate requires a smooth metal substrate. The process described in the '700 published patent application called for depositing an insulating layer on the substrate, followed by fabricating the thin-film mechanical sensor on the insulating layer. In attempting to fabricate an embeddable sensor using the method described in the '700 published patent application, the inventors discovered that the surface continuity of the high melting temperature metal substrate was insufficient for the disclosed techniques. The commercially available metal substrates, while having an appropriate average surface roughness, proved to have sudden unacceptable discontinuities and deep surface cracks. These irregularities on the surface of the initial metal substrate would ultimately leave gaps free of insulating material in the deposited insulating layer.

These gaps, even on a small scale, were critical flaws when attempting to fabricate a working thin-film thermomechanical sensor. Because the thin-film thermomechanical sensors were fabricated directly on top of the insulating layer, any gaps in the insulating layer would allow the sensors to short to the metal substrate. This short between the sensor and the substrate, and thus the bulk material, created by a void in the insulating material, would render any sensor fabricated on such a discontinuity useless. In addition, the cost of conventionally produced metal wafers having the appropriate average surface roughness, even if they were usable as substrates in this method, makes it difficult, if not impossible, to produce an embedded sensor using this method at a commercially acceptable price.

The commercially available metal substrates are insufficient for this process because they were not designed for microelectronics grade use. A microelectronics-grade metal substrate is required before the process described in the '700 published patent application will be capable of producing working embedded thin-film sensors. The inventors of the subject matter of this application have determined that it would be advantageous to be able to fabricate a microelectronics grade metal substrate, to form thin film sensors and the like that are attached to such microelectronics grade metal substrate and to embed such thin-film sensors and the like, along with the microelectronics grade metal substrate, into a metal mass.

This invention provides a method for producing microelectronics grade metal substrates.

This invention further provides a method for batch production of microelectronics grade metal substrates.

This invention separately provides a metal substrate that avoids surface discontinuities.

This invention separately provides a metal substrate having a mirror-like finish or better at a commercially acceptable price.

This invention separately provides methods for fabricating a microelectronics grade metal substrate.

This invention separately provides systems and methods for forming a microelectronics grade metal substrate using a sacrificial substrate.

This invention separately provides a thin film sensor and/or device formed and/or provided on or over a microelectronics grade metal substrate.

This invention separately provides a metal embeddable sensor and/or device that includes a thin film sensor and/or device and a microelectronics grade metal substrate.

This invention separately provides methods for fabricating thin-film sensors and/or devices on or over a sacrificial substrate and transferring the formed thin-film sensors and/or devices to a microelectronics grade metal substrate.

This invention separately provides methods for encapsulating a thin film sensor and/or device that is positioned on or over a microelectronics grade metal substrate.

This invention separately provides methods for embedding a thin film sensor and microelectronics grade metal substrate in high melting temperature bulk material.

This invention separately provides methods for creating fins, micro-channels, or other structural features the surface of a microelectronics grade metal substrate.

In various exemplary embodiments of methods and structures according to this invention, a method for fabricating a microelectronics metal substrate uses a sacrificial silicon wafer as a substrate on which the microelectronics grade metal substrate is formed. In various exemplary embodiments, an adhesion layer of titanium is deposited on or over the surface of the sacrificial silicon substrate. In various exemplary embodiments, a seed layer of the high melting temperature metal is deposited on or over the adhesion layer. In various exemplary embodiments, a layer of the high melting temperature material is grown on top of the seed layer using an electroplating or other low temperature and/or low stress process to form a microelectronics-grade metal wafer. In various exemplary embodiments, the sacrificial silicon substrate is then completely etched away from the rest of the material, leaving a continuous, low-roughness microelectronics-grade metal substrate. The microelectronics grade metal substrate reduces, and ideally eliminates, surface defects and discontinuities. An etch stop layer may be grown on top of the sacrificial silicon substrate before depositing the adhesion and seed/wafer materials, or any other high melting point electroplatable material. This etch stop layer can be used, for example, to ensure that the surface of the resulting microelectronics-grade metal wafer really is smooth and defect-free.

In various exemplary embodiments of methods and structures according to this invention, sensors, including thin film mechanical, thermomechanical or other types of sensors, optic sensors, and/or any other desired and appropriate devices and/or sensors, may be fabricated on or over the sacrificial silicon substrate before forming the microelectronic grade metal substrates. In various exemplary embodiments, the sensors and/or devices may be fabricated on top of an etch stop layer that is on or over the sacrificial silicon substrate using standard photolithography techniques.

In various exemplary embodiments of methods and structures according to this invention, desirable surface features may be formed, for example, by using a low temperature, low stress process, such as, for example, electroplating to provide additional material on or over the continuous low-roughness microelectronics grade metal substrate. In various exemplary embodiments, these surface features may include fins, cooling channels, or other micro-scale structures and/or surface enhancements. In various exemplary embodiments, these surface features are created by depositing a patterned photoresist on the surface of a microelectronics grade metal substrate and then adding more material onto the substrate using a low temperature, low stress process, such as, for example, electroplating, to create the desired features. In various exemplary embodiments, these structural and/or surface features may be used to dissipate heat around the embedded component, to transport material or impulses through the channels or other features formed in the microelectronics grade metal substrate, or for any other appropriate purpose.

These and other features and advantages of various exemplary embodiments of systems and methods according to this invention are described in, or are apparent from, the following detailed description of various exemplary embodiments of methods and devices according to this invention.

BRIEF DESCRIPTION OF DRAWINGS

Various exemplary embodiments of methods and devices of this invention will be described in detail, with reference to the following figures, wherein.

DETAILED DESCRIPTION OF EXEMPLARY EMBODIMENTS

Figure 1:
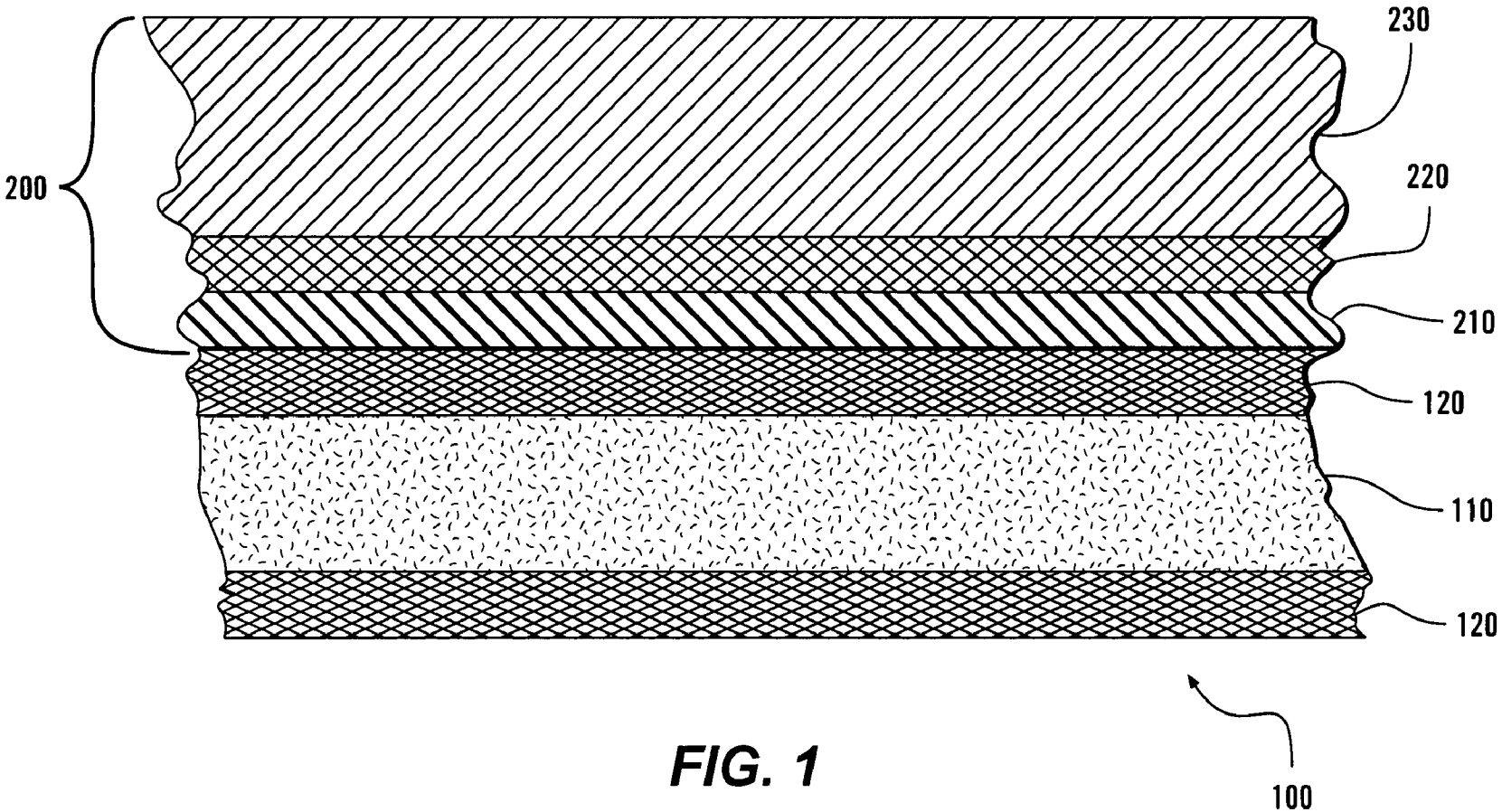
FIG. 1 is a cross-sectional view of a continuous low-average-roughness microelectronics grade metal substrate before the sacrificial silicon substrate has been etched away.

The following exemplary embodiments refer specifically to a sacrificial wafer or substrate. It should be appreciated that, in practice, the sacrificial substrate would typically be a silicon wafer. However, this is due primarily to the ready availability and low cost of silicon wafers. In systems and methods according to this application, any material that can be easily and completely removed without damaging the devices and metal substrate formed on or over the sacrificial substrate would be a suitable sacrificial substrate. Any references to the "sacrificial silicon substrate" are instructive of the sacrificial nature of the substrate and not the composition.

In-situ monitoring of operating conditions, such as, for example, temperature and/or strain, of mechanical tools and/or components in a harsh industrial environment is important. Microsensors are attractive for such applications due to their much smaller sizes compared to macro sensors. Additionally, microsensors may be incorporated into mechanical structures with minimal interference to normal operation of such tools and/or components. The small size of these microsensors enables them to respond to environmental changes, such as, for example, strain, temperature, and/or vibration, more rapidly than ordinary macrosensors. Moreover, microsensors have been shown to provide superior spatial resolution over macrosensors.

To implement microsensors into real industrial processes, they must be able to survive hostile environments. Accordingly, microsensors need to be embedded to avoid direct exposure to external hostile environments, such as, for example, thermo-mechanical shock, chemicals, corrosion, moisture, contamination and the like, and embedded at critical locations without interfering with the normal operation of the mechanical structures. Challenges for embedding such sensors arise because most of those mechanical structures used in hostile industrial environments, such as, for example, manufacturing, energy utilization, automotive, and oil exploration and extraction and the like, are metallic, and therefore conductive.

Thin film microsensors, such as thermocouples and strain gages, have drawn considerable attention in recent years because of their small size, fast response, low cost, and flexibility in design and materials. Thin film sensors, when embedded, can be used for structural health monitoring in high-performance production environments as well as in manufacturing process optimization. Sensors fabricated on metal substrates are attractive from an embedding perspective, as they are compatible with tools, equipment, and structural components in manufacturing environments. Metal encapsulated or embedded micro sensors are much more robust than standard silicon based devices.

Thin film sensors should be fabricated on and covered by insulating layer(s), rather than semiconductive or conductive materials. Selecting appropriate insulating film(s) is crucial to sensor survival and stability, as this layer will isolate the sensor electrically from the underlying metallic substrate and from the final protective embedding layer. Two parameters considered when selecting such appropriate insulating film(s) are the coefficient of thermal expansion (CTE) and the dielectric strength of the material(s) used to form the appropriate insulating film(s). The quality of the insulating film(s), in terms of existence of pinholes, coverage, and the like, may also be considered.

In various exemplary embodiments of devices and methods according to this invention, a batch production method for forming metal embedded thin film microsensors based on standard microfabrication techniques and electroplating has been developed. Microstructures and nanostructures can be fabricated on a silicon wafer, or a wafer of some other suitable material, and can be directly transferred and embedded onto electroplated metal layers without using expensive pre-formed microelectronic-grade metal substrates. Moreover, since pre-formed microelectronic grade metal substrates are not readily available, this technique can also be used to provide high quality metal surfaces, such as microelectronic grade metal substrates.

FIG. 1 shows one exemplary embodiment of a continuous metal substrate 230 formed on or over a sacrificial silicon substrate 110 and illustrates one exemplary method for forming a continuous metal substrate 230. As shown in FIG. 1, etch stop layers 120 are first formed on or over each surface of the sacrificial silicon substrate 110. It should be appreciated that, if the sacrificial silicon substrate 110 can be removed without damaging the continuous metal substrate 230 without needing the etch stop layer 120, the etch stop layers 120 can be omitted. Additionally, it should be appreciated that only the top etch stop layer 120 is actually needed. Thus, if the top etch stop layer 120 can be provided without having to form the bottom etch stop layer 120, the bottom etch stop layer 120 can be omitted.

The top etch stop layer 120 subsequently has a number of layers 200 deposited on or over it. The layers 200 include an adhesion layer 210, a seed layer 220, and an electroplated layer 230. In various exemplary embodiments, to form the continuous metal layer 230, an adhesion layer 210 is deposited on or over the top etch stop layer 120, or if the etch stop layer 120 is omitted, the silicon substrate 110. In various exemplary embodiments, the adhesion layer 210 is deposited by a sputtering process or similar techniques. However, any deposition process that results in an appropriate adhesion layer 210 can be used. This adhesion layer 210 will allow the desired metal substrate material to be deposited onto the top etch stop layer 120, or, if it is omitted, the sacrificial silicon substrate 110. Without the adhesion layer 210, the desired metal substrate material may not adhere adequately to the surface of the top etch stop layer 120, or, if it is omitted, the sacrificial silicon substrate 110 during sputtering, electroplating or other appropriate method for depositing the seed layer 220 and/or the continuous metal layer 230.

Once the thin adhesion layer 210 is deposited on or over the top etch stop layer 120 or the sacrificial silicon substrate 110, a seed layer 220 of the metal substrate material is deposited on or over the adhesion layer 210. In various exemplary embodiments, the seed layer 220 is formed using a sputtering process. However, any deposition process that results in an appropriate seed layer 220 can be used. After the seed layer 220 is deposited, an electroplating process is applied to the silicon substrate 110, during which the electroplated layer 230 is grown on or over the seed layer 220. While the adhesion layer 210 and the seed layer 220 will typically be relatively thin, such as, for example, on the order of about approximately 50 nm to about approximately 100 nm for the adhesion layer 210 and on the order of about approximately 250 nm to about approximately 350 nm for the seed layer 220, the electroplated layer 230 will typically be relatively thick, such as, for example, on the order of about approximately 0.25 mm to about approximately 2 mm, in comparison.

It should be appreciated that the sacrificial silicon substrate 110 may in fact be any smooth and continuous removable substrate on which the high melting temperature metal material may be deposited. Alternatively, it should be appreciated that the sacrificial silicon substrate 110 may be any removable substrate on or over which a smooth and continuous etch stop layer, on which the high melting temperature metal material may be deposited, can be provided. It is not critical that the sacrificial substrate 110 be silicon, but rather that the selected substrate 110 and/or an etch stop layer 120 that is formed on or over the selected substrate 110 be suitable for microelectronics grade processes. Ideally, there is no deep surface cracking on the surface of the sacrificial substrate 110 and/or on the surface of an etch stop layer 120 that is formed on or over the selected substrate 110. Furthermore, the sacrificial substrate 110 should be a material that may be completely removed via an etching or similar process that does not negatively affect the surface properties of the continuous metal layer 230.

It should also be appreciated that the adhesion layer 210 may or may not be required, depending on the difficulty involved in getting the seed layer 220 and/or the continuous metal layer 230 to bond with and/or deposit onto the sacrificial layer 110 and/or the etch stop layer 120 without using the adhesion layer 210. It should be appreciated that the adhesion layer 210 may be, and typically will be, different in composition from that of the seed layer 220 and the continuous metal layer 230. Likewise, it should also be appreciated that the seed layer 220 may or may not be required, depending on the difficulty involved in getting the continuous metal layer 230 to bond with and/or deposit onto the sacrificial layer 110, the etch stop layer 120 and/or the adhesion layer 210, depending on which of these layers is actually provided.

It should also be appreciated that the seed layer 220 and the continuous metal layer 230 may be any metal material that is desirably usable as a substrate. Such materials may include, for example, nickel, copper, chromium, iron and alloys of one or more of these materials, composites and any other material that can be deposited by electrochemical deposition or other low-stress and/or low-temperature process.

It should also be appreciated that the seed layer 220 and the continuous metal layer 230 may be different in composition from each other and additionally that the seed layer 220 and/or the continuous metal layer 230 may be an alloyed material.

It should also be appreciated that the steps used to produce the microelectronics grade metal substrate 200 are desirably performed using low temperature, low stress methods. Low temperature or room temperature processes, such as electroplating or any other appropriate known or later developed process, allow for the structure of the metal substrate material deposited on or over the sacrificial silicon substrate and/or the etch stop layer to match as closely as possible to the crystal structure of the substrate and/or the etch stop layer at room temperature. If deposition was performed at substantially high temperatures, upon cooling, the difference in the coefficients of thermal expansion between the sacrificial semiconductor substrate and/or the etch stop layer and the metal substrate may result in thermally induced stress, ultimately resulting in the de-lamination or cracking of the weaker material. Such induced stress will often lead to unacceptable surface imperfections in the metal substrate that will render it less useful for microelectronics grade applications.

Figure 2:
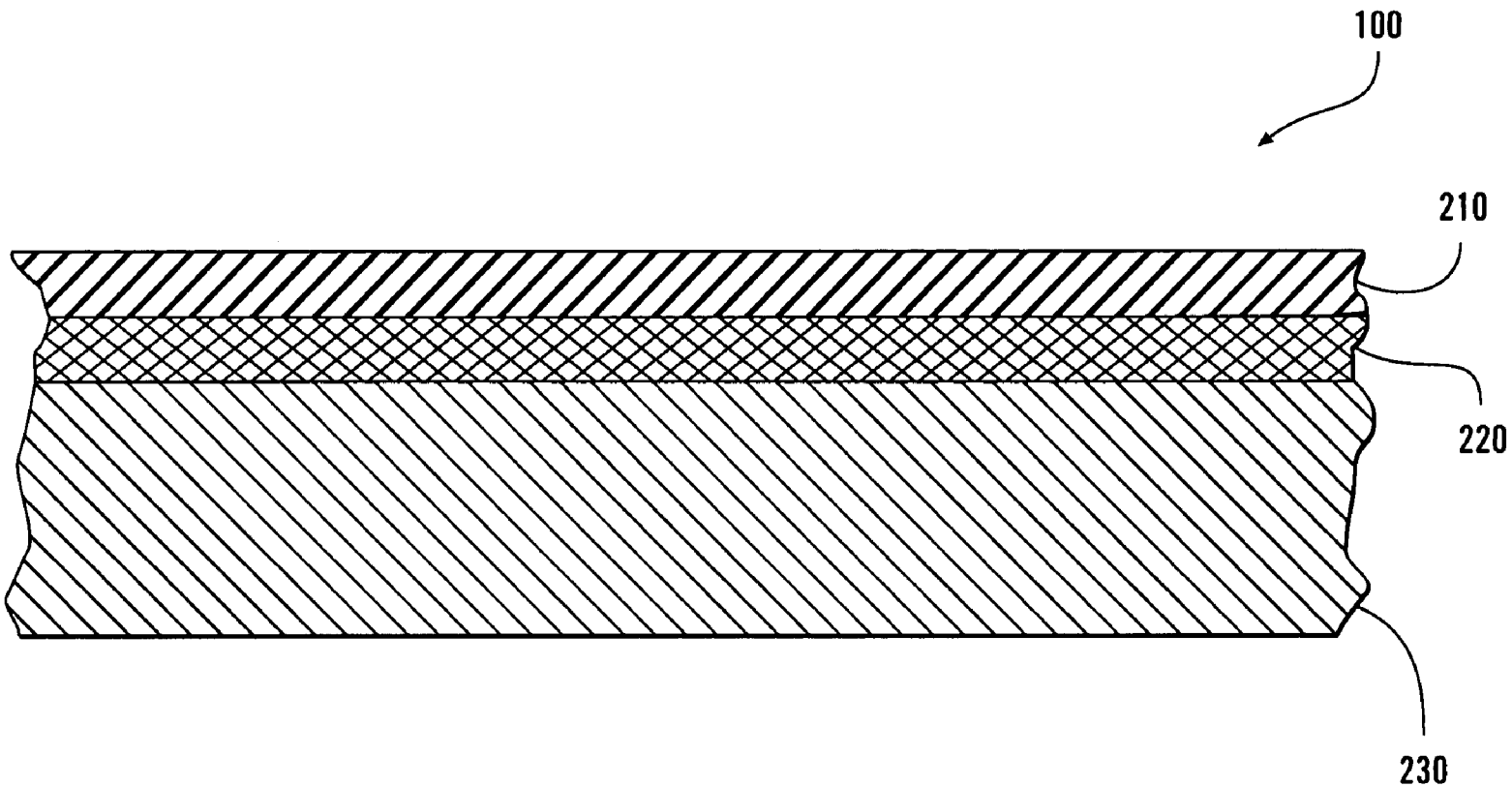
FIG. 2 is a cross-sectional view of the microelectronics grade metal substrate after the sacrificial silicon substrate has been completely etched away and the etch stop layer has been removed.

FIG. 2 shows the structure in FIG. 1 after the sacrificial substrate 110 is completely etched away or otherwise removed by a comparable process, and after the etch stop layer 120 is completely removed. When the sacrificial substrate 110 is silicon, KOH is suitably usable to etch away the mass of the sacrificial wafer 110. In various exemplary embodiments, the sacrificial silicon wafer 110 is completely etched out in a 30% KOH solution at 80° C. It should be appreciated that any other suitable etching or removal process could be used in place of wet KOH etching. The etch stop layer(s) 120 can be removed by dry etching, for example, or using any other suitable process. If the bottom etch stop layer 120 was also formed, it can be removed by dry etching or other suitable process prior to etching away the sacrificial silicon layer 110. It should be appreciated that, for various exemplary continuous metal layers 230 that were formed by the inventors according to this process, the average roughness of the continuous metal layer 230 was about 6nm as measured by an Alpha step profiler.

It should be appreciated that, while FIG. 2 depicts the adhesion layer 210, the seed layer 220, and the electroplated layer 230 as separate entities, the adhesion layer 210 and seed layer 220 are generally indistinguishable from each other and the continuous metal layer 230, based on their relative thickness compared to the continuous metal layer 230. In various exemplary embodiments, the adhesion layer 210 will probably not be observable as a continuous layer as depicted in FIG. 2, but rather a trace element that is found on one surface of the metal substrate. Likewise, as the seed layer 220 is often the same material as the continuous metal layer 230, the seed layer 220 will, in many exemplary embodiments, disappear as a separate layer into the bulk material of the continuous metal layer 230.

It should further be appreciated that, if the adhesion layer 210 is not desired, whether it is a separately identifiable layer or merely remains as a trace material on the exposed surface of the continuous metal layer 230, the adhesion layer 210 can be removed by subjecting that exposed surface of the continuous metal layer 230 to an appropriate etchant. In various exemplary embodiments, this appropriate etchant will be one that etches away the material used in the adhesive layer 210 without significantly affecting the exposed surface of the continuous metal layer 230. Ideally, that etchant will not affect the exposed surface of the continuous metal layer 230 at all.

It should also be appreciated that, if an etchant is used to remove the sacrificial wafer 110, the etchant should be able to completely remove the material the wafer is composed of while not damaging the continuous metal substrate 230. However, it should be appreciated that the etch stop layer, which is located between the sacrificial wafer 110 and the adhesion layer 210 as shown in FIG. 1, may be used to prevent damage to the continuous metal substrate 230 from the etchant used to remove the sacrificial layer 110.

Figure 3:
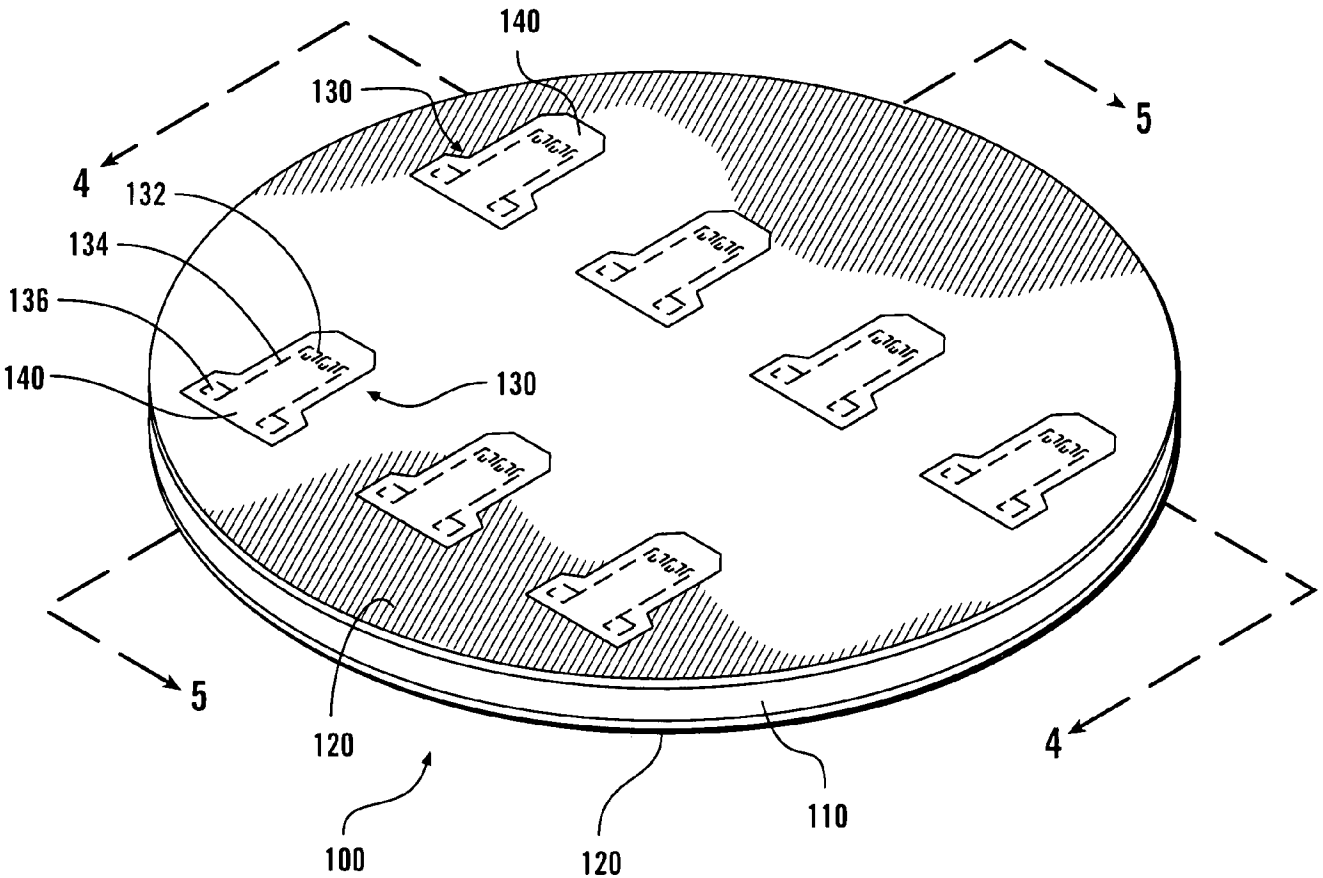
FIG. 3 is a perspective view of a batch of thin film sensors produced on a sacrificial silicon substrate before forming the microelectronic grade metal substrate.

FIG. 3 shows the result of performing one exemplary embodiment of a batch process usable to fabricate multiple thin-film sensors on a silicon wafer. FIG. 3 shows the resulting structures prior to forming the adhesion layer 210, the seed layer 220 and the electroplated layer 230. As shown in FIG. 3, the etch stop layer 120 is formed on or over the sacrificial substrate 110. In various exemplary embodiments, the etch stop layer 120 is formed by vapor deposition. In this exemplary embodiment, the etch stop layer 120 is silicon nitride ($Si_xN_y$), and is formed by low-pressure chemical vapor deposition. The silicon nitride ($Si_xN_y$), etch stop layer is typically about 1.0 μm thick.

One or more thin-film mechanical, thermomechanical or other type of sensors 130 are subsequently formed on or over the etch stop layer 120. The thin-film sensors 130 are typically formed using standard photolithography techniques. As shown in FIG. 3, multiple thin film sensors 130 may be formed on or over the top etch stop layer 120 and the single silicon wafer 110. In various exemplary embodiments, the thin-film sensors 130 are strain gages and thus include a testing mass 132, a pair of leads 134, and a pair of contact pads 136. Depending on the final use, the contact pads 136 may be completely covered after an insulating/dielectric material layer 140 has been deposited, as shown in FIG. 3, or may be remain exposed. As shown in FIG. 3, a dielectric layer 140 can be used to cover the thin-film sensors 130. After forming the micro-electronics grade metal substrate 230, this layer will eventually lie below the thin film sensor 130 after etching away the sacrificial silicon wafer 110 and the various etch stop layers 120. This dielectric layer 140 will electrically isolate the thin film sensors 130 from the microelectronics grade metal substrate 230.

It should be appreciated that the inventors investigated three types of etch stop layers: thermal $SiO_2$, $Si_xN_y$ deposited using PECVD and $Si_xN_y$ deposited using LPCVD. Of these materials, only $Si_xN_y$ deposited by LPCVD was found to be robust enough to sustain the prolonged KOH etching (which can take up to 8 hours) that is necessary to completely etch away the 300 μm-thick silicon wafer that was used as the sacrificial silicon substrate in the inventors' experiments. It should be appreciated that other etch stop layer materials and/or structures that are robust enough to withstand the prolonged KOH etching can also be used. It should further be appreciated that, if the sacrificial silicon layer can be etched away using another etchant, any etch stop material and/or structure that can withstand that etchant sufficiently to allow the sacrificial silicon layer to be removed can be used.

In various exemplary embodiments, to form the thin film sensors 130, a photoresist is applied and then patterned using a sensor array mask and standard optical lithography (such as i-line, 365 nm). In various exemplary embodiments, the thin-film sensors are formed by sputtering an alloy comprising 90% nickel and 10% chromium (Ni90/Cr10) to a thickness of 150 nm. The thin-film sensors 130 are then obtained following a lift-off process. In various exemplary embodiments, the dielectric layer 140 is formed by depositing two layers of $Al_2O_3$ to a thickness of about 0.5 μm thick for each layer and a intermediate layer of $Si_xN_y$ to a thickness of about 1.5 μm thick, by electron beam evaporation and PECVD, respectively, to form an insulating $Al_2O_3/Si_xN_y/Al_2O_3$ multilayer dielectric layer 140 over the thin-film sensors 130, the sacrificial silicon wafer 110 and/or the top etch stop layer 120.

It should be appreciated that, in various exemplary embodiments, this insulating $Al_2O_3/Si_xN_y/Al_2O_3$ multilayer dielectric layer 140 is formed by selectively depositing the various materials using a silicon hard mask. This multilayer dielectric layer 140 uses these sublayers, formed in this order, to cover potential pinholes in each single dielectric sublayer and to minimize thermal stresses caused by a mismatch of coefficients of thermal expansion (CTE) values between the dielectric layer 140 and the metals, such as, for example, the thin-film sensors 130 and the subsequently-formed nickel embedding layers. In various other exemplary embodiments, the insulating $Al_2O_3/Si_xN_y/Al_2O_3$ multilayer dielectric layer 140 is formed as a continuous layer. The insulating $Al_2O_3/Si_xN_y/Al_2O_3$ multilayer dielectric layer 140 can then be covered with a photoresist. The photoresist can be patterned and one or more suitable etchants can be used to remove the relevant portions of the photoresist and the underlying portions of the insulating $Al_2O_3/Si_xN_y/Al_2O_3$ multilayer dielectric layer 140 that are not over the thin-film sensors 130 and surrounding areas of the sacrificial silicon wafer 110 and/or the top etch stop layer 120.

Figure 4:
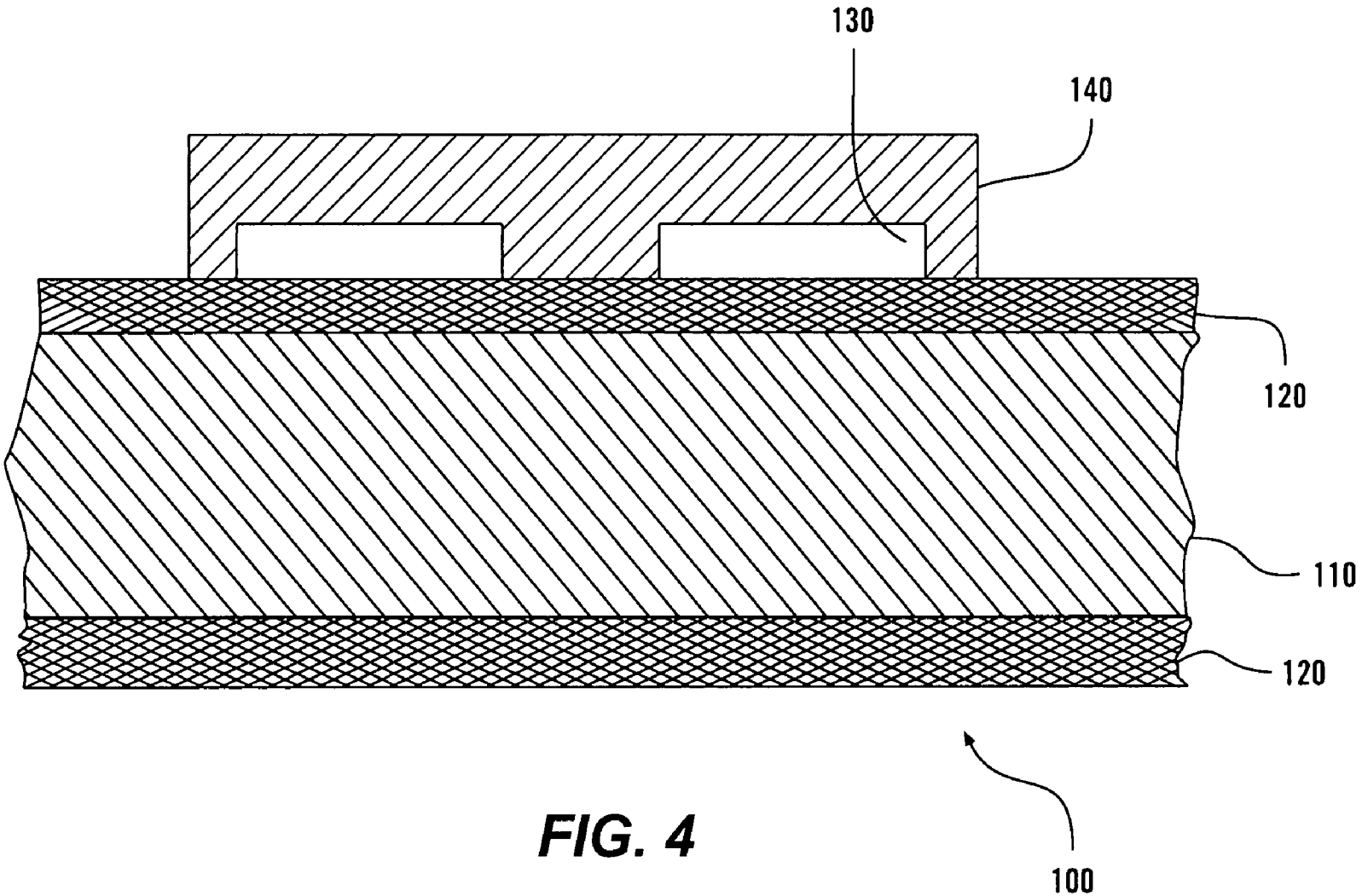
FIG. 4 is a first cross-sectional view of the thin film sensor of FIG. 3 along a first direction before the microelectronic grade metal substrate has been formed or the silicon substrate has been etched away.
Figure 5:
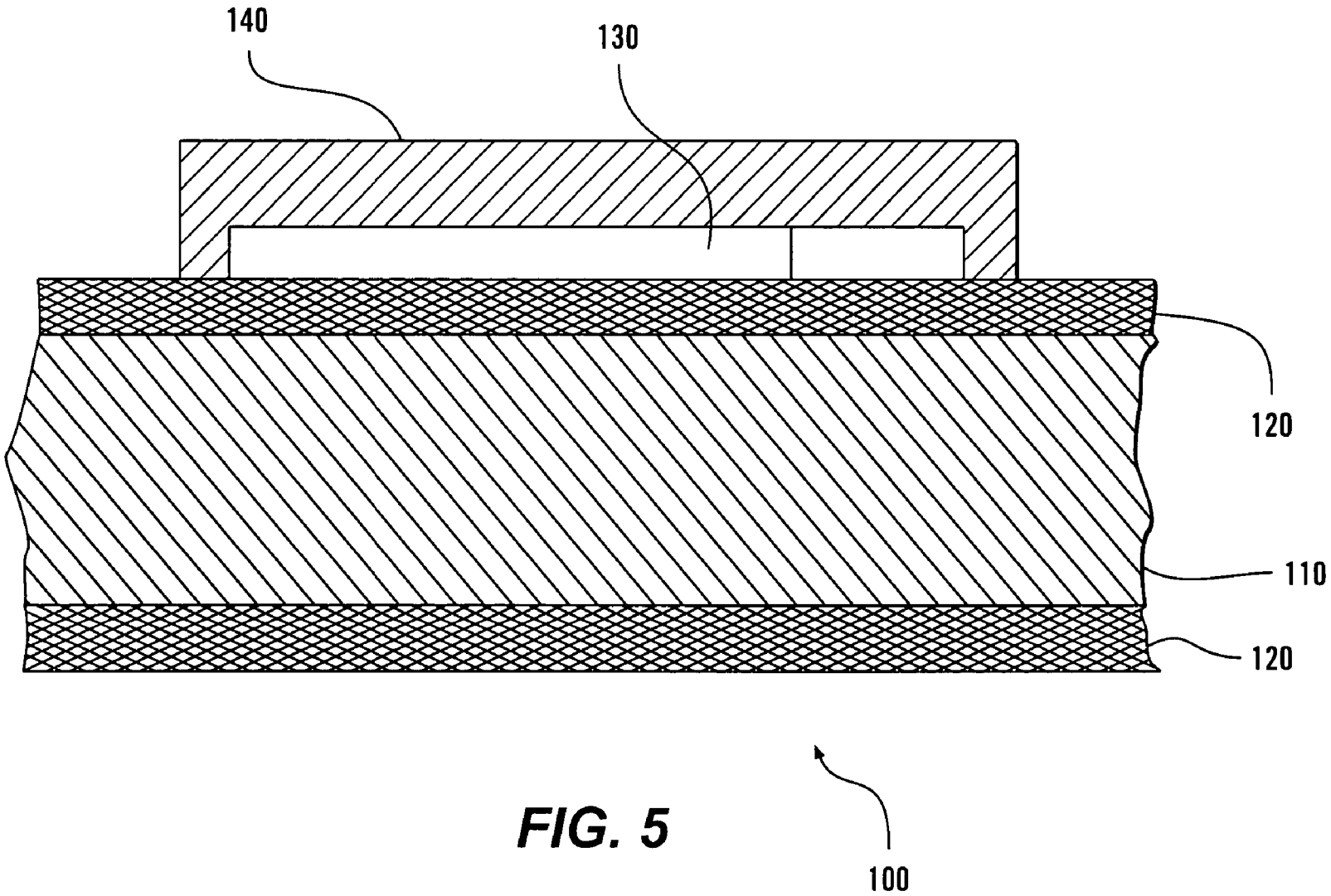
FIG. 5 is a second cross-sectional view of the thin-film sensor of FIG. 3 along a second direction before the microelectronic grade metal substrate has been formed or the silicon substrate has been etched away.

FIG. 4 shows a cross-sectional view through the structure 100 shown in FIG. 3, through the wafer 110 along a direction that is perpendicular to the long axis of the sensors 130. FIG. 5 shows another cross-sectional view through the structure 100 shown in FIG. 3, through the wafer 110 along a direction that is parallel to the long axis of the sensors 130. As shown in FIGS. 4 and 5, the etch stop layer 120 is deposited on or over the sacrificial substrate 110. It should also be appreciated that, in various exemplary embodiments, as shown in FIGS. 4 and 5, etch stop layers 120 can be formed on or over both sides of the sacrificial silicon wafer 110. After the etch stop layer 120 is formed, the sensor 130 is formed on or over the etch stop layer 120. Once the sensors 130 have been formed on or over the surface of the etch stop layer 120 and/or the sacrificial substrate 110, then the single-layer or multi-layer insulting or dielectric layer 140 is deposited on or over each of the sensors 130, and over the etch stop layer 120 and/or the sacrificial substrate 110 to completely cover the sensors 130, or, in other exemplary embodiments, cover at least selected portions of the sensors 130.

In various exemplary embodiments, the dielectric or insulating material 140 can be placed over selected portions of the sacrificial substrate 110. The dielectric or insulating layer 140 can cover portions of the sensors 130 that would be sensitive to direct contact with the bulk material in which the sensor 130 will be encapsulated. Other portions of the sensor 130, however, such as the contact pads 136, can remain uncovered by the dielectric or insulting layer 140 so that they may be put in contact with leads to obtain the measurement signals generated by the sensor 130. It should be appreciated that, in various exemplary embodiments, this first dielectric or insulting layer 140 shown in FIGS. 3-5 will typically cover the entire sensors 130. A subsequent dielectric or insulting layer 140 that is formed on or over the opposite side of the sensors 130 after the sacrificial silicon layer 110 and the various etch stop layers 120 are removed will typically leave portions of the sensors 130 uncovered.

It should be appreciated that there are multiple ways to form the sensors 130. The most typical method may use standard photolithography techniques, sputtering and lift-off. However, it should be appreciated that there may be other ways to fabricate sensors for encapsulation other than standard photolithography techniques.

It should also be appreciated that the dielectric or insulating layer 140 is present to electrically insulate the sensors 130 from the mass of material in which the sensors 130 will be encapsulated and ultimately embedded. The dielectric or insulating layer 140 may be for example, alumina ($Al_2O_3$) or silicon nitride ($Si_xN_y$), or both, as described above. The dielectric or insulating layer 140 should be continuous and sufficiently thick to prevent electrical short circuits from forming between the sensors 130 and the embedding layers 210-230.

Figure 6:
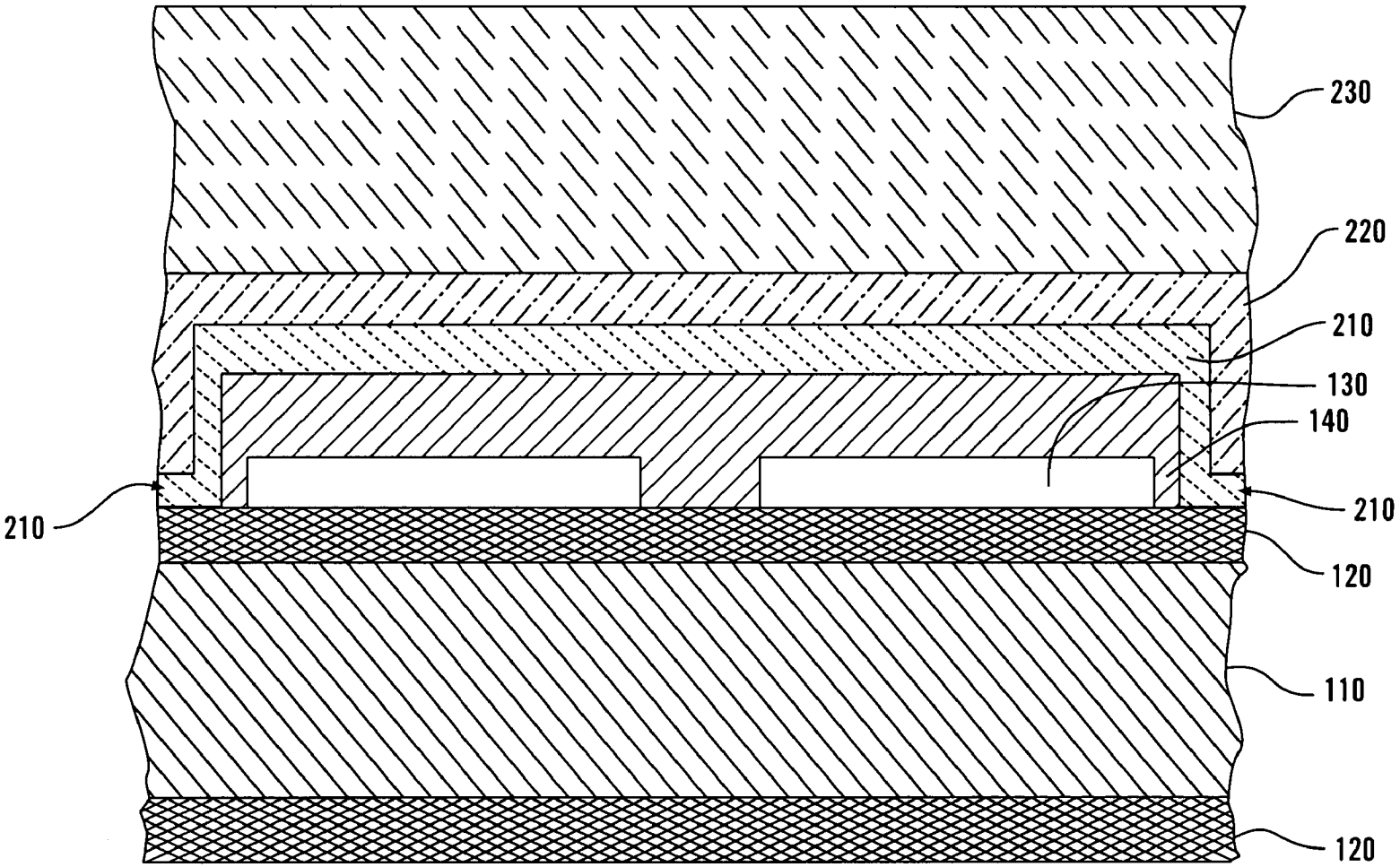
FIG. 6 is a cross-sectional view of the embedded sensor after the adhesion layer, the seed layer and the electroplated layer have been deposited, but prior to etching the sacrificial silicon substrate.

FIG. 6 shows the wafer 110 shown in FIGS. 3-5 after the layers 210-230 have been formed. As shown in FIG. 6, and similar to the discussion set forth above regarding FIG. 1, once the insulating or dielectric layer 140 has been deposited, the adhesion layer 210 is deposited on or over the insulating or dielectric layer 140 and the exposed portions of the top etch stop layer 120 and/or the sacrificial silicon substrate 110. Once the adhesion layer 210 has been placed on or over the insulating dielectric layer 140 and the exposed portions of the top etch stop layer 120 and/or the sacrificial silicon substrate 110, a seed layer 220 is formed on or over the adhesion layer 210. Once the seed layer 220 has been formed, the entire wafer 110 may be placed into an electroplating bath so that the continuous metal substrate 230 may be electroplated over the substrate 110 from the nucleation sites created by the seed layer 220. The seed layer 220 can be patterned by using a thick photoresist such as, for example, the photoresist SU-8, before electroplating. This will typically allow individual sensor units to be easily separated after electroplating.

Figure 7:
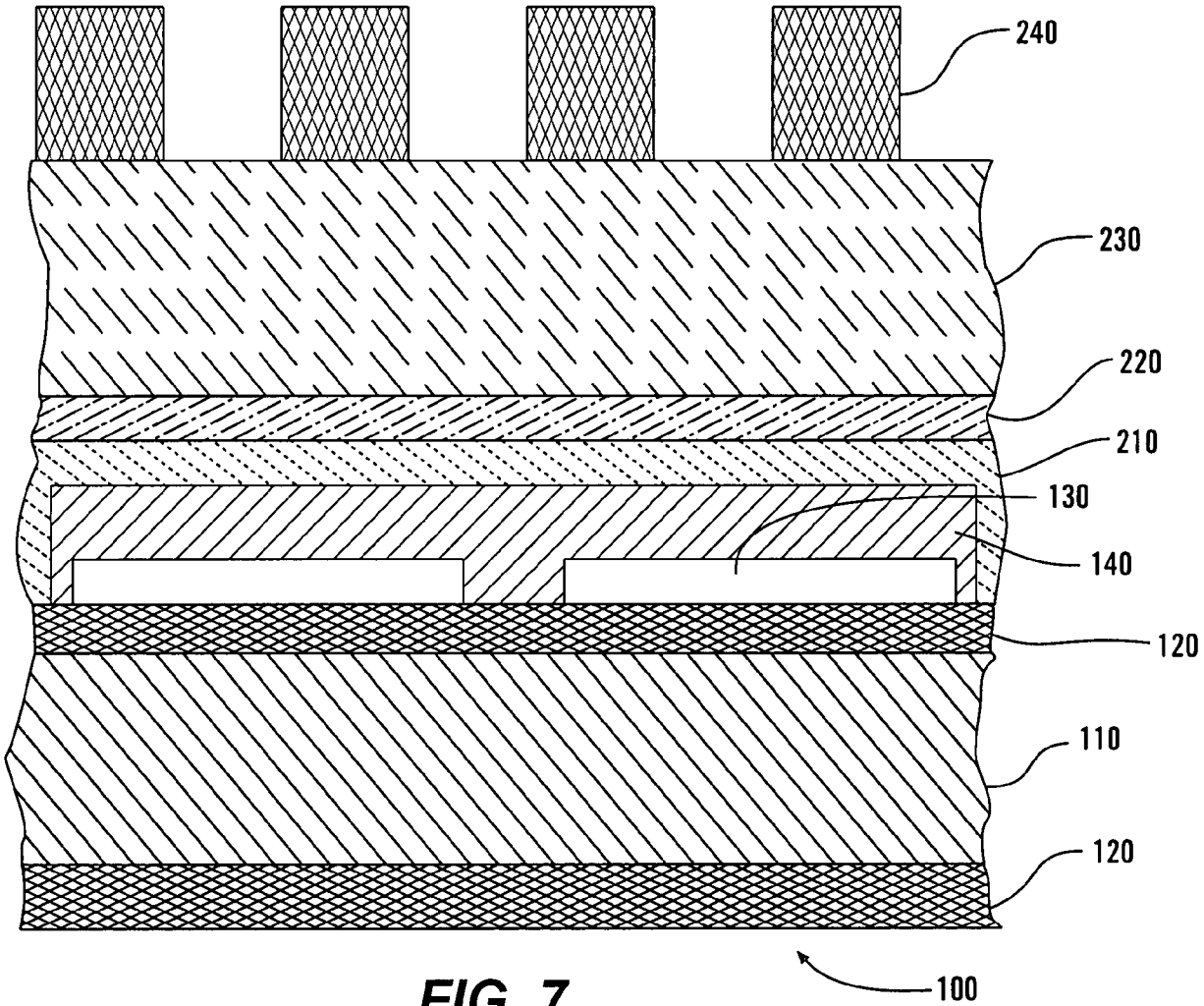
FIG. 7 is a cross-sectional view of one exemplary embodiment of a device according to this invention after a photoresist has been placed on top of the electroplated layer.

FIG. 7 shows one exemplary embodiment of the wafer 110 as shown in FIG. 6, after a photoresist 240 has been deposited on or over the electroplated continuous metal substrate 230. Once the electroplating or other low temperature, low stress process for forming the continuous metal layer 230 is complete, a photoresist 240 may be placed on or over select portions of the continuous metal layer 230. The photoresist 240 will serve as a template of sorts for further patterned deposition. Certain areas of the photoresist will be made soluble or insoluble by exposing the photoresist to a curing agent, such as ultra violet light through a patterned template. The soluble portions of the photoresist 240 may then be removed. Additional material, such as the material used to form metal substrate layer 230, can then be deposited, such as by electroplating or using another material deposition process, according to the pattern formed in the photoresist onto the continuous metal layer 230.

Figure 8:
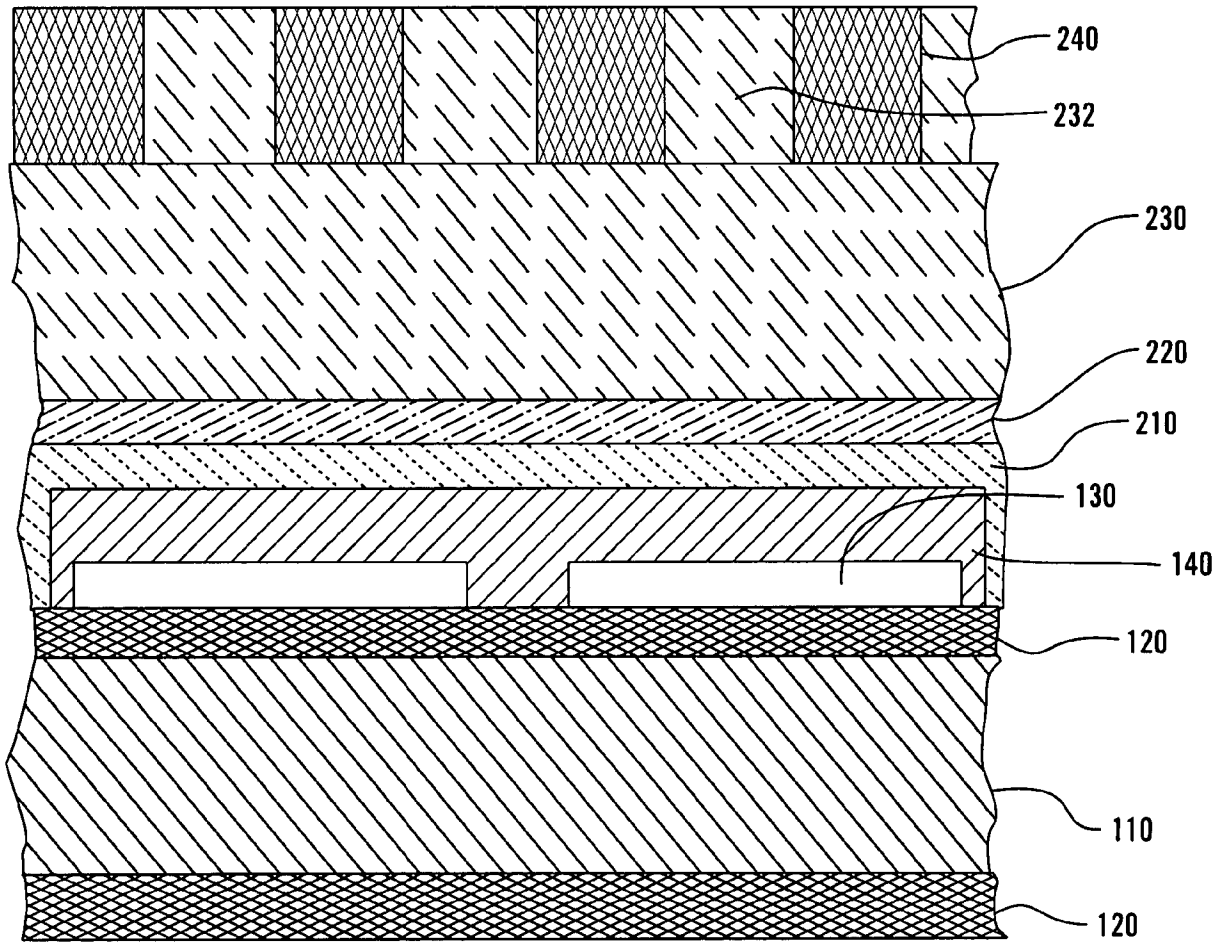
FIG. 8 is a cross-sectional view of the sensor of FIG. 7 after further depositing the metal, but prior to removing the photoresist.

FIG. 8 shows one exemplary embodiment of the device I 00 after a desired amount of additional metal substrate material 232 has been deposited or electroplated between the gaps or vias in the photoresist 240. As shown in FIG. 8, the additional material 232 fills in the gaps or vias between the photoresist but is not deposited or provided on or over the photoresist 240. It should be appreciated that the photoresist 240 may be patterned in any desired shape. The additional material 232 may then be deposited on or over the surface of the electroplated layer 230 using a low-temperature, low-stress deposition method to form, based on the patterned photoresist 240, fins, micro-channels, and/or any other desired structural and/or surface features.

Figure 9:
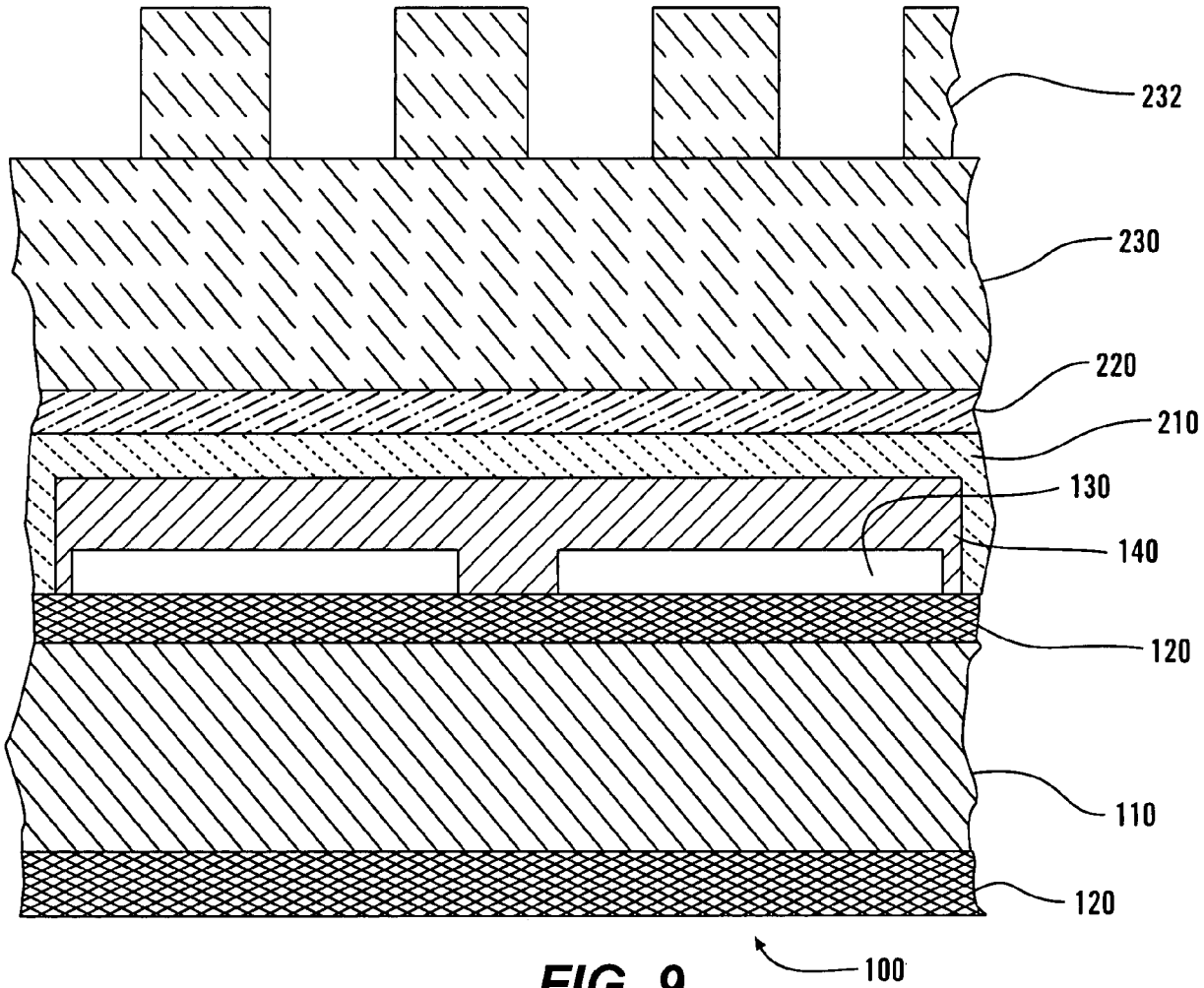
FIG. 9 is a cross-sectional view of the sensor of FIG. 8 after the photoresist has been removed.

FIG. 9 shows one exemplary embodiment of the device 100 of FIG. 8 after the additional material 232 has been deposited and the photoresist 240 has been removed. In various exemplary embodiments, this additional material 232 is similar in composition to the material forming the continuous metal layer 230.

Figure 10:
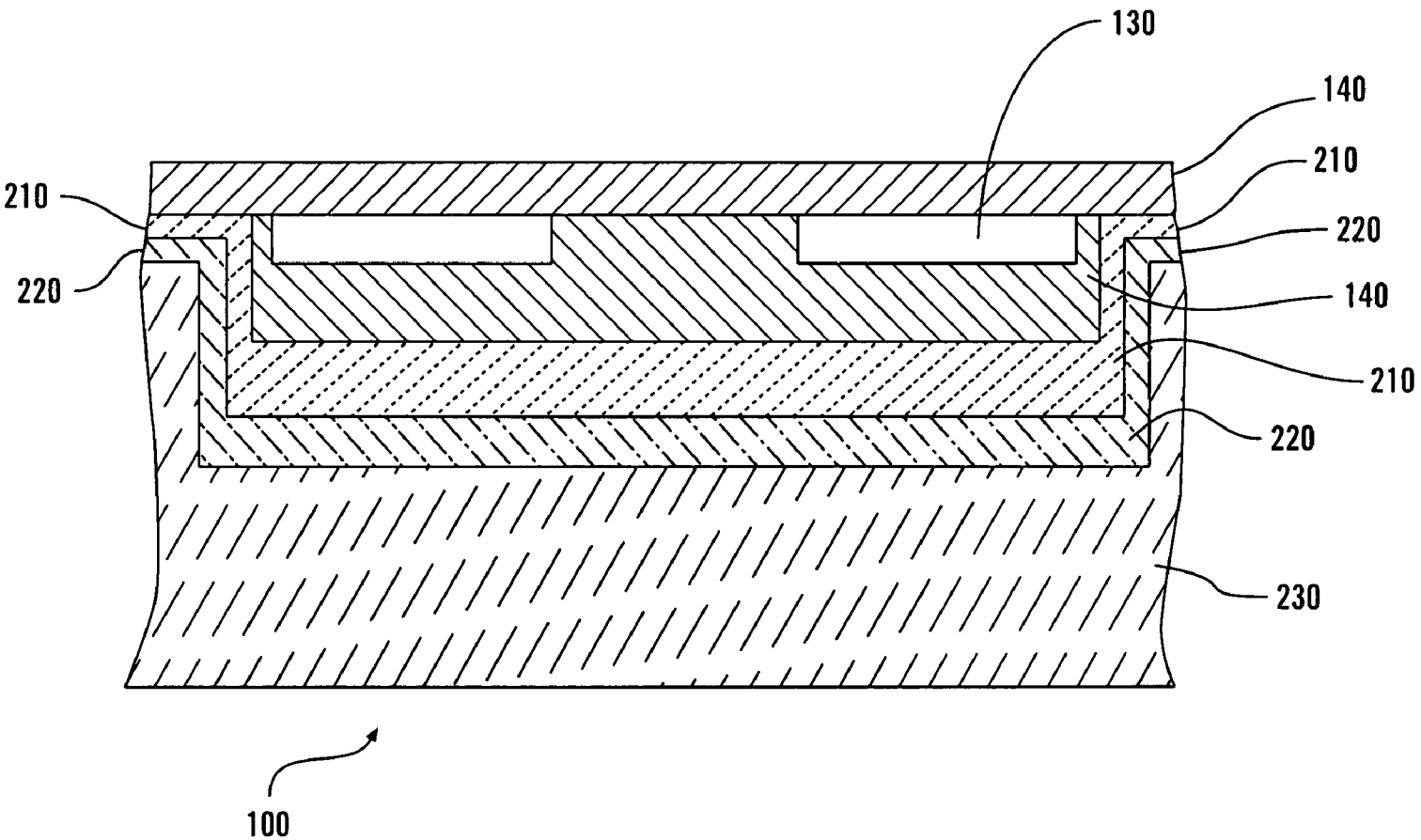
FIG. 10 is a cross-sectional view of an embedded sensor after the sacrificial silicon substrate has been completely etched away, the etch stop layer has been removed and a second insulating layer has been provided.

FIG. 10 shows one exemplary embodiment of the device 100 after the sacrificial substrate 110 and the various etch stop layers 120 have been etched away or otherwise removed. If the sacrificial substrate 110 is silicon, then the sacrificial silicon substrate 110 may be removed by a wet chemical etchant, such as KOH. If the etch stop layers 120 are silicon nitride, they may be removed using a dry etch process. Once the sacrificial substrate 110 and the various etch stop layers 120 have been removed, then further processing may be done to completely encapsulate each of the sensors 130 and embed each sensor 130 into the desired bulk material. It should be appreciated, again, that the sacrificial substrate 110 may be removed in a number of ways, of which a wet chemical etch is just one example. Likewise, it should be appreciated, again, that the etch stop layers 120 may be removed in a number of ways, of which a dry etch is just one example.

Figure 11:
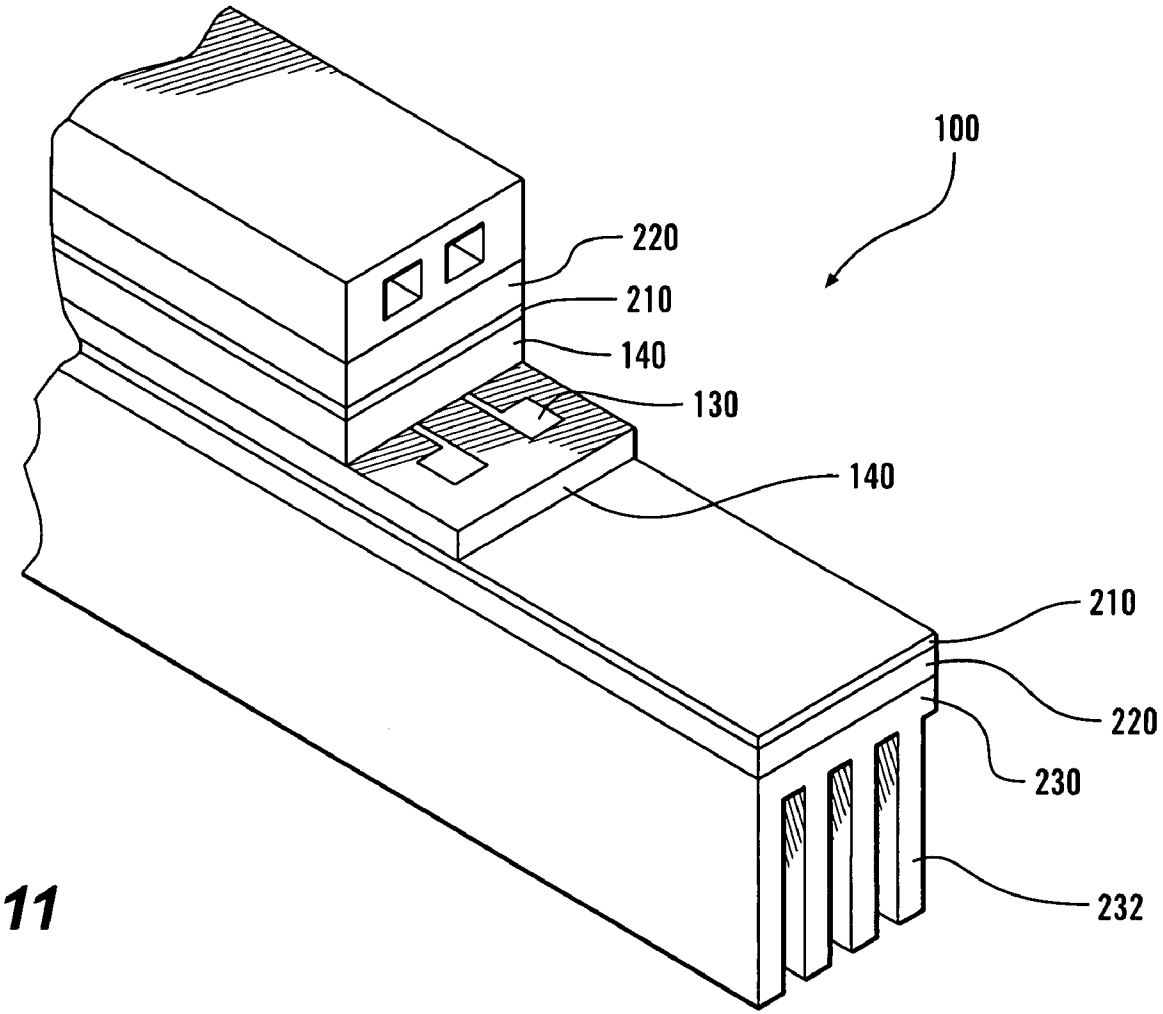
FIG. 11 is a perspective view of one exemplary embodiment of a device that includes a completed embeddable sensor, which has fabricated thin fins on one face and cooling channels fabricated on the other face.

FIG. 11 depicts one such exemplary embodiment of this post-processing encapsulation. In particular, FIG. 11 shows one exemplary embodiment of a sensor that has been covered by additional layers of a bulk material after the sacrificial silicon substrate 110 and the one or more etch stop layers 120 have been etched away. The bottom etch stop layer 120 on the back side of the sacrificial silicon wafer 110, if formed, is first removed using a dry etching process. The sacrificial silicon wafer 110 is then etched away as outlined above. Once the sacrificial silicon substrate 110 has been etched away, the top etch stop layer 120 is then exposed. In various exemplary embodiments, the exposed top etch stop layer 120 is then completely removed using a dry etch process. A second dielectric layer 140, comprising, for example, the three dielectric layers $Al_2O_3/Si_xN_y/Al_2O_3$ is deposited to cover at least part of the exposed surface of the thin-film sensor 130 to finish isolating the thin-film sensor 130 from the metal layers provided during subsequent embedding/encapsulation processes. In various exemplary embodiments, a second adhesion layer 212 is then deposited on or over the second dielectric layer 140 and the exposed portions of the previously-formed metal layers 200. Once the second adhesion layer 210 is deposited, a second seed layer 220 may be formed on or over the second adhesion layer 210 using sputtering or similar processes. After the second seed layer 200 is deposited, an electroplating process or other low temperature, low stress process may be used to form a second metal layer 230, which may be formed using the material used to form the continuous metal layer 230.

It should be appreciated that fins, micro-channels or other structural and/or surface enhancements may be formed on this side of the device 100 as well. FIG. 11 shows one exemplary embodiment of the device 100 that includes fins 234 on one side and cooling channels formed by the second metal layer 230 and the additional material 232, and 236 provided on the opposite side of the device 100. Photoresist may be deposited on the surface of the second metal layer 230 and patterned. Additional surface features can then be formed by further electroplating or depositing material using a low temperature, low stress process.

Figure 12:
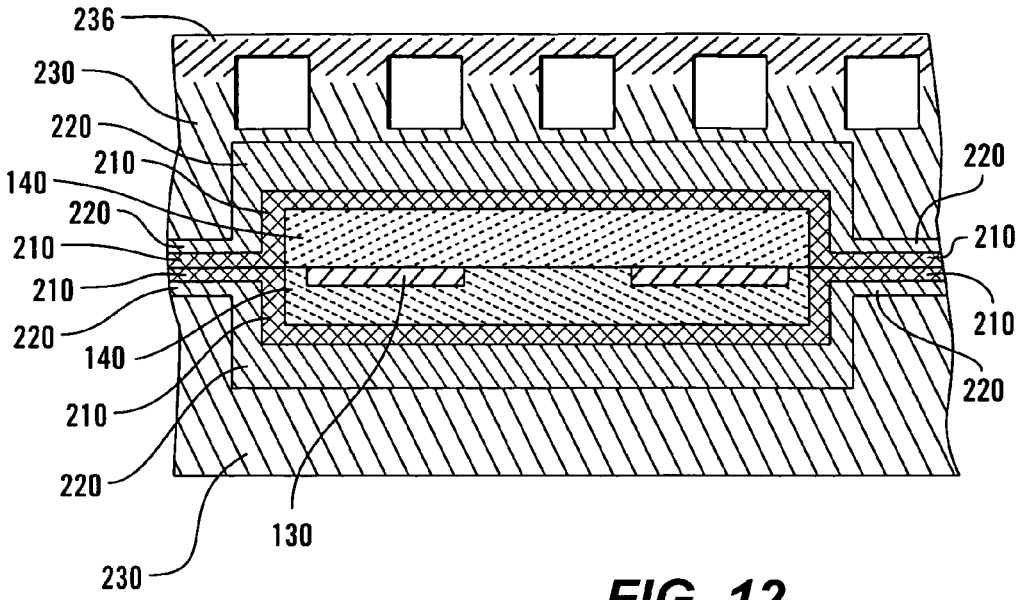
FIG. 12 is a cross-sectional view of one exemplary embodiment of a device that includes a completed embeddable thin film mechanical sensor having cooling channels.

FIG. 12 is a side cross-sectional view of one exemplary embodiment of an encapsulated sensor device 100 in which micro-channels have been fabricated on or over a second metal layer 230. Photoresist 240 is deposited in selected areas over the second metal layer 230. The photoresist 240 is patterned using methods, such as standard photolithography techniques, which allow the additional material 232 to be selectively deposited on or over the second metal layer 230. Once the second metal layer 232 has been deposited, a thick additional metal layer 236 may be deposited using, for example, electroplating or other low temperature, low stress processes, on or over the second metal layer 232 prior to removing the photoresist 240. Once the photoresist 240 is patterned, channels may be formed by depositing material on or over the second metal layer 230 until the height of the deposited material sufficiently exceeds the height of the photoresist.

Once the height of the deposited material exceeds the height of the photoresist 240, the additional material 236 will be deposited not just in the direction perpendicular to the working face of the second metal layer 230, but also parallel to this surface. Once the thickness of the additional material 236 that is provided over the photoresist 240 is sufficiently thick, the microchannels have been formed. The photoresist 240 may then be removed. FIG. 12 depicts one exemplary device 100 after the photoresist 240 has been removed, leaving only small micro-channels within the second metal layer 230 and the additional material 232 and 236.

It should be appreciated that electroplating is only one low temperature, low stress method for forming the metal layers 230 and/or for forming unique surface features such as fins or channels over one or both of the metal layers 230. While electroplating is presently the most economical method for depositing material to form the fins and channels, other deposition methods, especially any other known or later-developed low temperature, low stress method may be used instead.

Figure 13:
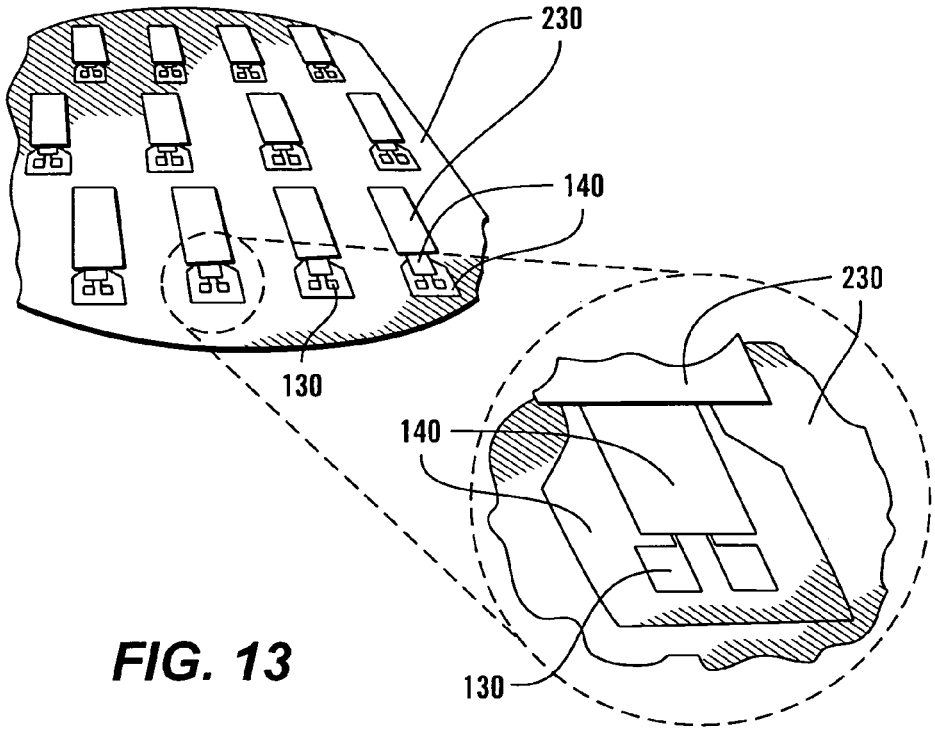
FIG. 13 is a perspective view of thin film sensors formed on a microelectronics grade metal substrate according to this invention after the sacrificial silicon substrate has been completely etched away, the etch stop layer has been removed, a second insulating layer has been provided, and a second metal layer has been provided to effectively encapsulate the sensor.

FIG. 13 is a top plan view of a microelectronics grade substrate 230 after etching away the sacrificial silicon substrate 110 and the etch stop layers 120, after the thin-film sensors 130 have been deposited, after the second insulating or dielectric material 140 has been deposited, and after the second adhesion layer 210, the second seed layer 220 and the second continuous metal layer 230 have been provided. In the exemplary embodiment show in FIG. 13, the the first and second insulating or dielectric layers 140 are used to insulate the thin-filmed sensors 130 from the first and second continuous metal layers 230. Areas that include the leads and contact pads of the sensors 130 are areas which have not been covered by the second insulating or dielectric layer 140. It should be appreciated that these encapsulated sensors 130 may be embedded in the bulk of the material by casting, cladding, or any other appropriate known or later-developed process.

A single metal embedded sensor unit can be diced out of the completed metal wafer structure and be placed into larger metallic structures. Solid-state bonding techniques, such as, for example, ultrasonic welding, can be used to bond the metal embedded sensor to metal parts in critical manufacturing locations to collect useful thermo-mechanical data that could facilitate in-depth understanding of production environments.

While various exemplary embodiments according to this invention have been described above, various alternatives, modifications, variations, improvements, and/or substantial equivalents, whether known or that are or may be presently unforeseen, may become apparent to those having at least ordinary skill in the art. Accordingly, the exemplary embodiments according to this invention, as set forth above, are intended to be illustrative, not limiting of the scope of this invention. Various changes may be made without departing from the spirit and scope of this invention. Therefore, this invention is intended to embrace embodiments beyond those outlined above, as well as all known or later-developed alternatives, modifications, variations, improvements, and/or substantial equivalents of the exemplary embodiments outlined above.

What is claimed is:

1. A method for forming a device carried by a metallic substrate using a sacrificial substrate, comprising:

forming the device on or over the sacrificial substrate;

depositing an insulating layer on or over the device;

depositing a metallic substrate material on or over at least the insulating layer using a low temperature, low stress process to form a metallic substrate; and removing at least a portion of the sacrificial substrate;

wherein:

the insulating layer electrically isolates at least a portion of the device from the metallic substrate; and after removing at least a portion of the sacrificial substrate, the device is carried by the metallic substrate.

2. The method of claim 1, further comprising:

depositing a second insulating layer on or over at least a portion of the device;

depositing an additional amount of the metallic substrate material on or over the second insulating using a low temperature, low stress process, wherein the additional amount of the metallic substrate material acts with the metallic substrate to encapsulate at least a portion of the device between the metallic substrate and the additional amount of the metallic substrate material.

3. The method of claim 2, further comprising depositing an adhesion layer on or over at least the second insulating layer, wherein depositing the additional amount of the metallic substrate material on or over the second insulating layer comprises depositing the additional amount of the metallic substrate material on or over the adhesion layer.

4. The method of claim 3, further comprising depositing a seed layer for the additional amount of the metallic substrate material on or over the adhesion layer, wherein depositing the additional amount of the metallic substrate material on or over the adhesion layer comprises depositing the additional amount of the metallic substrate material on or over the seed layer.

5. The method of claim 2, further comprising depositing a seed layer for the additional amount of the metallic substrate material on or over the second insulating layer, wherein depositing the additional amount of the metallic substrate material on or over the second insulating layer comprises depositing the additional amount of the metallic substrate material on or over the seed layer.

6. The method of claim 2, further comprising:

depositing a layer of photoresist on at least one exterior surface of the deposited metallic material;

patterning the photoresist;

removing areas of the photoresist based on the pattern;

depositing additional metallic material on the deposited metallic material in the removed areas of the photoresist; and removing the remaining photoresist.

7. The method of claim 1, further comprising forming an etch stop layer in, on or over at least the first surface of the sacrificial substrate, wherein forming the device on or over the sacrificial substrate comprises forming at least a portion of the device on or over the etch stop layer.

8. The method of claim 7, further comprising:

removing, after removing at least a portion of the sacrificial substrate, at least a portion of the etch stop layer formed in, on or over the first surface of the sacrificial substrate to expose at least a portion of the device;

depositing a second insulating layer on or over at least a portion of the exposed portion of the device;

depositing an additional amount of the metallic substrate material on or over the second insulating using a low temperature, low stress process, wherein the additional amount of the metallic substrate material acts with the metallic substrate to encapsulate at least a portion of the device between the metallic substrate and the additional amount of the metallic substrate material.

9. The method of claim 1, further comprising depositing an adhesion layer on or over at least one of the insulating layer and the first surface of the sacrificial substrate, wherein depositing the metallic substrate material on or over the insulating layer comprises depositing the metallic substrate material on or over the adhesion layer.

10. The method of claim 9, further comprising depositing a seed layer for the metallic substrate material on or over the adhesion layer, wherein depositing the metallic substrate material on or over the adhesion layer comprises depositing the metallic substrate material on or over the seed layer.

11. The method of claim 1, further comprising depositing a seed layer for the metallic substrate material on or over at least one of the insulating layer and the first surface of the sacrificial substrate, wherein depositing the metallic substrate material on or over the insulating layer comprises depositing the metallic substrate material on or over the seed layer.

12. An intermediate component usable in manufacturing a microelectronics device, comprising:

a sacrificial wafer;

a microelectronics device formed on or over the sacrificial wafer;

an insulating layer formed on or over the device;

a metallic substrate material layer formed on or over the insulating layer; and a seed layer formed on or over the insulating layer and between the insulating layer and the metallic substrate material layer.

13. An intermediate component usable in manufacturing a device, comprising:

a sacrificial wafer;

a device formed on or over the sacrificial wafer;

an insulating layer formed on or over the device;

a metallic substrate material layer formed on or over the insulating layer; and fins formed on or over the metallic substrate material layer.

14. An encapsulated device formed by a method comprising: forming an etch stop layer on or over at least a first surface of a sacrificial substrate;

forming the device on or over the etch stop layer;

depositing an insulating layer on or over the device;

depositing an adhesion layer on or over at least one of the insulating layer and the first surface of the sacrificial substrate;

depositing a seed layer for a metallic substrate material on or over the adhesion layer; and depositing the metallic substrate material on or over the seed layer using a low temperature, low stress process to form a metallic substrate;

removing at least a portion of the sacrificial substrate;

wherein:

the insulating layer electrically isolates at least a portion of the device from the metallic substrate; and after removing at least a portion of the sacrificial substrate, the device is carried by the metallic substrate.

15. The method of claim 14, further comprising:

removing at least a portion of at least the etch stop layer to expose at least a portion of the device;

depositing a second insulating layer on or over at least a portion of the exposed portion of the device;

depositing a second adhesion layer on or over at least the second insulating layer;

depositing a second seed layer for the metallic substrate material on or over the second adhesion layer; and depositing an additional amount of the metallic substrate material on or over the second seed layer of the metallic substrate material using a low temperature, low stress process.

16. The method of claim 15, wherein depositing the additional metallic substrate material comprises encapsulating the microelectronic device between the metallic material and the additional amount of the metallic material.

17. The method of claim 15, further comprising:

depositing a layer of photoresist on at least one surface of the deposited metallic material;

patterning the photoresist;

removing areas of the photoresist based on the pattern;

depositing additional metallic material on the deposited metallic material in the removed areas of the photoresist; and removing the remaining photoresist.

* * * * *